US010145374B2

(12) United States Patent
Yonemoto et al.

(10) Patent No.: US 10,145,374 B2
(45) Date of Patent: Dec. 4, 2018

(54) SCREW COMPRESSOR

(71) Applicant: Johnson Controls—Hitachi Air Conditioning Technology (Hong Kong) Limited, Hong Kong (CN)

(72) Inventors: Ryuichiro Yonemoto, Tokyo (JP); Takeshi Tsuchiya, Tokyo (JP); Eisuke Kato, Tokyo (JP); Kotaro Chiba, Tokyo (JP); Yasuaki Iizuka, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 119 days.

(21) Appl. No.: 15/300,959

(22) PCT Filed: Dec. 15, 2014

(86) PCT No.: PCT/JP2014/083126
§ 371 (c)(1),
(2) Date: Sep. 30, 2016

(87) PCT Pub. No.: WO2015/159459
PCT Pub. Date: Oct. 22, 2015

(65) Prior Publication Data

US 2017/0030356 A1 Feb. 2, 2017

(30) Foreign Application Priority Data

Apr. 18, 2014 (JP) ..... 2014-086521

(51) Int. Cl.
*F04C 18/16* (2006.01)
*F04C 28/12* (2006.01)
(Continued)

(52) U.S. Cl.
CPC ..... *F04C 28/125* (2013.01); *F04C 18/16* (2013.01); *F04C 28/12* (2013.01); *F04C 28/24* (2013.01);
(Continued)

(58) Field of Classification Search
CPC ..... F04C 28/12; F04C 28/125; F04C 18/16
(Continued)

(56) References Cited

U.S. PATENT DOCUMENTS 4,457,681 A * 7/1984 Garland ..... F04C 28/125 417/440
4,575,323 A 3/1986 Yoshimura
(Continued)

FOREIGN PATENT DOCUMENTS

JP 09-317676 A 12/1997
JP 3778460 B2 5/2006
(Continued)

OTHER PUBLICATIONS

International Search Report of PCT/JP2014/083126 dated Mar. 10, 2015.

*Primary Examiner* — Peter J Bertheaud
(74) *Attorney, Agent, or Firm* — Mattingly & Malur, PC

(57) ABSTRACT

A slide valve forming a part of a bore and movable in an axial direction of the rotors, foot sections on a discharge side end face of the slide valve, and discharge ports and on a discharge chamber side of the slide valve in order to discharge compressed gas taken into a compression operation chamber from the suction chamber and compressed. At a discharge side end portion of the slide valve, first discharge channels and lead the compressed gas discharged from the discharge port and lead the compressed gas to the discharge chamber and second discharge channels are provided on a radial direction outer side of the first discharge channel and opened to the first discharge channels and the discharge chamber to lead a part of the compressed gas flowing in the first discharge channels and feed the part of the compressed gas to the discharge chamber.

10 Claims, 8 Drawing Sheets

(51) Int. Cl.
*F04C 29/12* (2006.01)
*F04C 28/24* (2006.01)

(52) U.S. Cl.
CPC ..... *F04C 29/12* (2013.01); *F04C 2240/20* (2013.01); *F04C 2240/30* (2013.01); *F04C 2240/81* (2013.01); *F04C 2270/185* (2013.01)

(58) Field of Classification Search
USPC ..... 417/310; 418/201.2
See application file for complete search history.

(56) References Cited

U.S. PATENT DOCUMENTS

| | | | | |
|---|---|---|---|---|
| 6,276,911 | B1 * | 8/2001 | Krusche | F04C 28/125 418/201.2 |
| 6,302,668 | B1 * | 10/2001 | Lee | F04C 28/12 418/201.2 |
| 8,221,104 | B2 * | 7/2012 | Wilson | F04C 28/12 417/310 |
| 8,272,846 | B2 * | 9/2012 | Flanigan | F04C 18/16 417/213 |
| 8,459,963 | B2 * | 6/2013 | Pileski | F04C 18/16 417/312 |
| 2014/0127067 | A1 | 5/2014 | Kienzle | |

FOREIGN PATENT DOCUMENTS

| | | | |
|---|---|---|---|
| JP | 2009-174395 | A | 8/2009 |
| JP | 6355336 | B2 | 11/2013 |
| WO | 2013/007470 | A1 | 1/2013 |

* cited by examiner

SCREW COMPRESSOR

TECHNICAL FIELD

The present invention relates to a screw compressor, and more particularly, is suitable as a screw compressor used in a refrigeration cycle apparatuses such as an air conditioner, a chiller unit, and a refrigerator.

BACKGROUND ART

A screw compressor used in an air conditioner, a chiller unit, and the like is used in wide ranges of suction pressures and discharge pressures. Therefore, depending on operation conditions, over-compression is likely to occur in which pressure in a screw rotor tooth groove (a tooth groove space) (pressure in a compression operation chamber) is higher than a discharge pressure. Therefore, in order to reduce the over-compression, for example, a screw compressor described in Patent Literature 1 (Japanese Patent No. 5355336) has been proposed.

The screw compressor described in Patent Literature 1 includes a male rotor (a main rotor) and a female rotor (a sub-rotor) that have substantially parallel rotation axes and rotate while meshing with each other, a casing that houses the male rotor and the female rotor and in which a suction port is formed on a low-pressure side and a discharge port is formed on a high-pressure side, and a volume ratio valve that performs reciprocating movement in a rotation axial direction of the female rotor and the male rotor while sliding with respect to the male rotor and the female rotor. The volume ratio valve is configured to form the discharge port in cooperation with the casing and moves in the axial direction, thereby being capable of changing a volume ratio of a tooth groove space (a compression operation chamber) formed by the male and female rotors and the casing.

In the volume ratio valve, an intermediate port for bleeding pressure in the tooth groove space is provided. When pressure in a discharge chamber is higher than the pressure in the tooth groove space bled from the intermediate port (an insufficient compression state), the volume ratio valve is moved to a discharge side, whereby the discharge port formed by the volume ratio valve is moved further to the discharge side to increase a set volume ratio. Consequently, insufficient compression is corrected.

Further, when the pressure in the discharge chamber is lower than the pressure in the tooth groove space bled from the intermediate port (an over-compression state), the volume ratio valve is moved to a suction side, whereby the discharge port formed by the volume ratio valve is moved to the suction side to reduce the set volume ratio. Consequently, over-compression can be reduced.

CITATION LIST

Patent Literature

Patent Literature 1: Japanese Patent No. 5355336

SUMMARY OF INVENTION

Technical Problem

However, in the screw compressor of Patent Literature 1 described above, it has been found that there are problems that should be solved described below. That is, in the screw compressor, when the pressure in the discharge chamber is higher than the pressure in the tooth groove space bled from the intermediate port (the insufficient compression state), the volume ratio valve moves to the discharge side. However, at this point, since a part of a valve main body of the volume ratio valve moves and enters the discharge chamber, the volume of the discharge chamber decreases. Therefore, there is a problem in that a flow of gas discharged from the discharge port is hindered and a pressure loss increases to cause performance deterioration. It has been found that, since the volume of the discharge chamber decreases, there is a problem in which pulsation of the discharged gas is less easily attenuated and vibration and noise increase.

In the screw compressor of Patent Literature 1 described above, when the diameter of the intermediate port formed in the volume ratio valve is increased, a fluctuating pressure in the tooth groove space forming the compression operation chamber flows into a backpressure chamber (a cylinder chamber on a counter rotor side) of a piston that drives the volume ratio valve. Therefore, the volume ratio valve reciprocatingly slides bit by bit in a rotor axial direction in association with pressure fluctuation in the compression operation chamber. In this regard, it has been found that there is also a problem in that vibration and noise increase and abnormal wear of a supporting section of the volume ratio valve is caused.

An object of the present invention is to obtain a screw compressor that can reduce a pressure loss of compressed gas discharged from a discharge port and flowing in a discharge chamber, make it easy to attenuate pulsation of gas discharged to the discharge chamber, and reduce vibration and noise.

Solution to Problem

In order to achieve the object, a characteristic of the present invention resides in a screw compressor including: a male rotor; a female rotor that meshes with the male rotor; a casing that includes a bore for housing the male rotor and the female rotor and in which a suction chamber is formed on a suction side and a discharge chamber is formed on a discharge side; a slide valve forming a part of the bore and provided to be movable in an axial direction of the male rotor and the female rotor; foot sections provided on a discharge side end face of the slide valve and for supporting the slide valve in the casing; and a discharge port provided on a discharge side of the slide valve in order to discharge, to the discharge chamber, compressed gas taken into a compression operation chamber formed by the male rotor, the female rotor, and the casing from the suction chamber and compressed. At a discharge side end portion of the slide valve, a first discharge channel for leading the compressed gas discharged from the discharge port and leading the compressed gas to the discharge chamber and a second discharge channel provided on a radial direction outer side of the first discharge channel and opened to the first discharge channel and the discharge chamber to lead a part of the compressed gas flowing in the first discharge channel and feed the part of the compressed gas to the discharge chamber.

Advantageous Effect of Invention

According to the present invention, there is an effect that a screw compressor can be obtained that can reduce a pressure loss of compressed gas discharged from a discharge port and flowing in a discharge chamber, make it easy to attenuate pulsation of gas discharged to the discharge chamber, and reduce vibration and noise.

DESCRIPTION OF EMBODIMENTS

Figure 1:
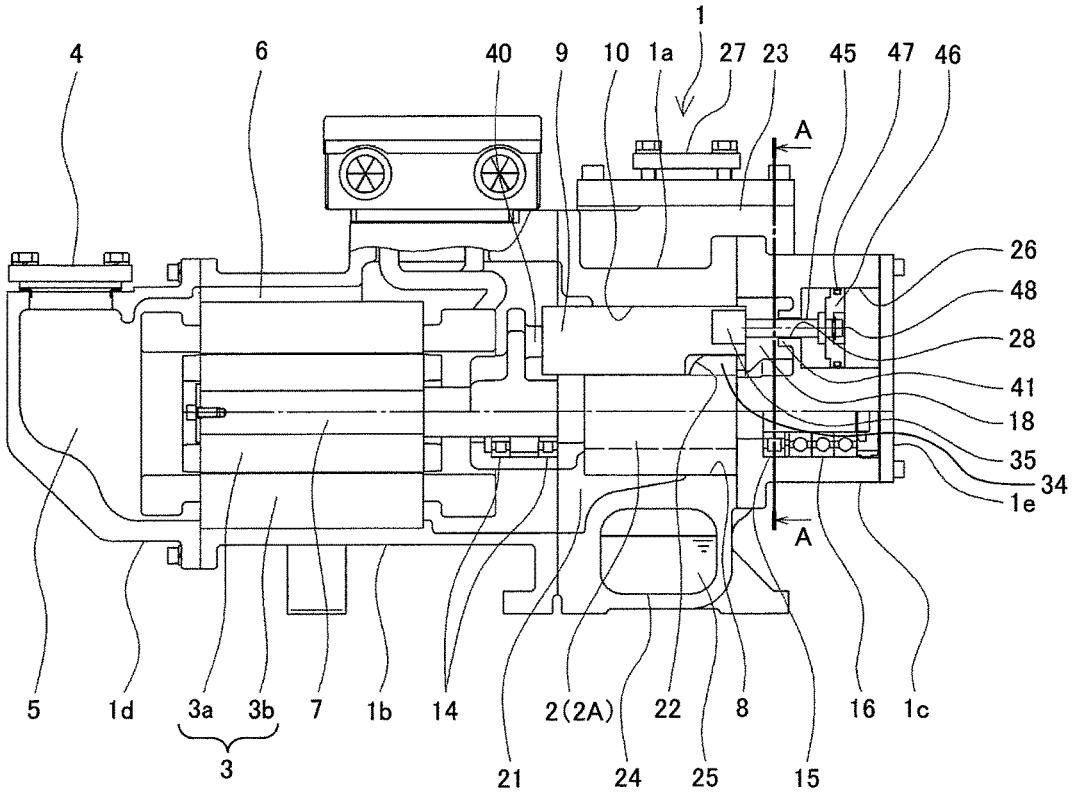
FIG. 1 is a longitudinal sectional view showing a first embodiment of a screw compressor of the present invention.

A specific embodiment of a screw compressor of the present invention is explained below with reference to the drawings. Note that, in the figures, portions denoted by the same reference numerals and signs indicate the same or equivalent portions.

First Embodiment

A first embodiment of the screw compressor of the present invention is explained with reference to FIG. 1 to FIG. 8.

Figure 2:
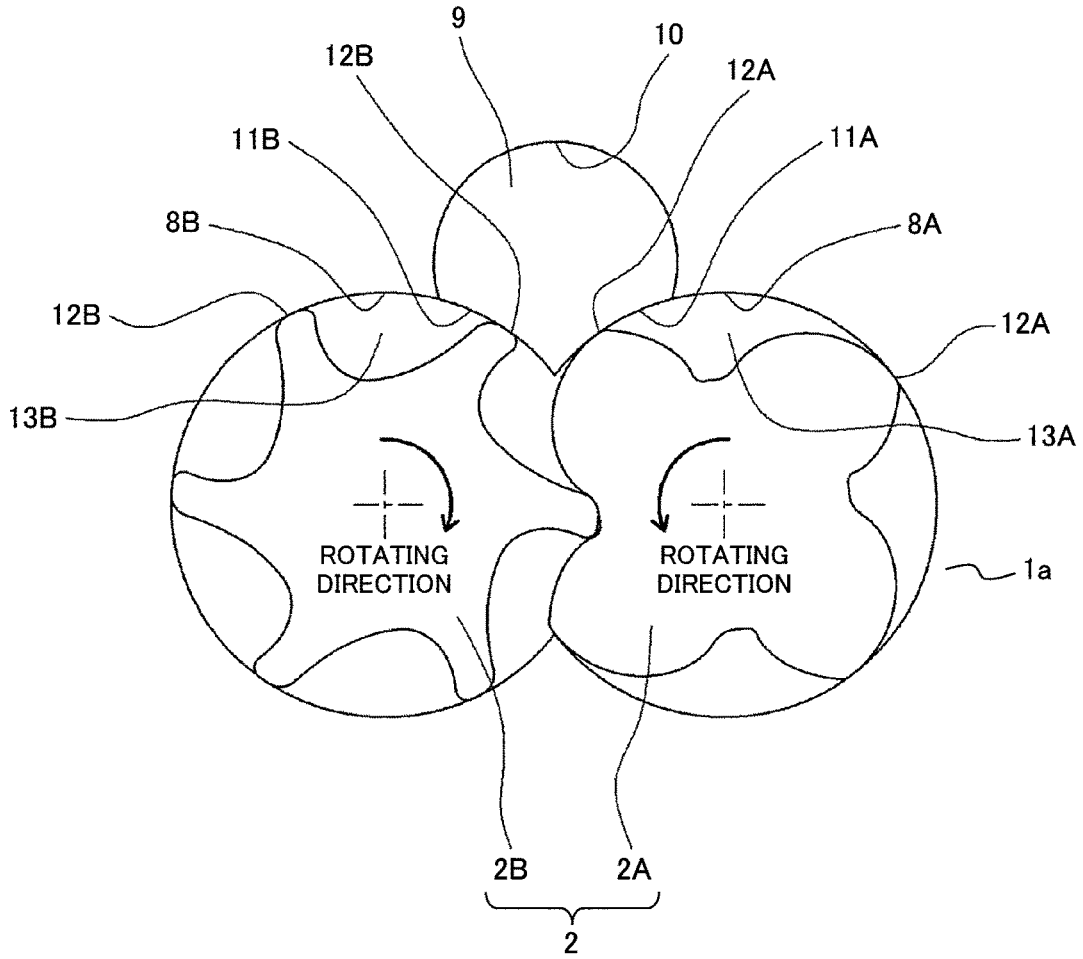
FIG. 2 is a schematic diagram of a screw rotor and a slide valve section shown in FIG. 1 viewed from a side surface direction.

First, the overall configuration of the screw compressor in the first embodiment is explained with reference to FIG. 1 and FIG. 2. FIG. 1 is a longitudinal sectional view showing the first embodiment of the screw compressor of the present invention. FIG. 2 is a schematic diagram of a screw rotor and a slide valve section shown in FIG. 1 viewed from a side surface direction.

In FIG. 1, reference numeral 1 denotes a screw compressor (a compressor main body). The screw compressor 1 includes casings such as a main casing 1*a* incorporating a screw rotor 2 and the like, a motor casing 1*b* connected to the main casing 1*a* and incorporating a motor (an electric motor) 3 and the like for driving the screw rotor 2, a discharge casing 1*c* connected to a discharge side of the main casing 1*a*, a motor cover 1*d* connected to a counter main casing 1*a* side of the motor casing 1*b*, and an end cover 1*e* connected to the counter main casing 1*a* side of the discharge casing 1*c*.

In the motor cover 1*d*, a sucking section 4 provided on a counter motor 3 side and a low-pressure chamber 5 communicating with the sucking section 4 are formed. Gas flows into the low-pressure chamber 5 from the sucking section 4. The motor 3 includes a rotor 3*a* attached to a rotating shaft 7 and a stator 3*b* disposed on the outer circumferential side of the rotor 3*a*. The stator 3*b* is fixed to the inner surface of the motor casing 1*b*.

A gas passage 6 is formed on the inner surface of the motor casing 1*b* to which the motor 3 is attached. The gas passage 6 is a suction passage for causing the low-pressure chamber 5 and the screw rotor 2 side to communicate.

In the main casing 1*a*, a cylindrical bore 8 for housing a tooth section of the screw rotor 2 is formed. In the main casing 1*a*, a slide valve (a volume ratio valve) 9 for forming a bore for housing the screw rotor 2 in conjunction with the bore 8 and changing a volume ratio (a ratio of a maximum closed volume on a suction side and a minimum closed volume on a discharge side) of the screw compressor is provided. The slide valve 9 is housed to be capable of reciprocatingly moving in an axial direction while sliding in a slide valve housing hole 10 formed in the main casing 1*a*.

A disposition configuration of the main casing 1*a*, the screw rotor 2, and the slide valve is explained with referenced to FIG. 2. The screw rotor 2 is configured from a male rotor 2A and a female rotor 2B that have parallel rotation axes and rotate while meshing with each other. The bore 8 formed in the main casing 1*a* is formed by a bore 8A for housing the male rotor 2A and a bore 8B for housing the female rotor 2B.

The slide valve housing hole 10 having a substantially cylindrical shape for housing the slide valve 9 is formed in upper parts of the bores 8A and 8B of the main casing 1*a*. The slide valve 9 is housed in the slide valve housing hole 10 and configured to be movable in parallel to an axis of the screw rotor 2.

On the bore 8 side of the slide valve 9, a bore 11 for housing the screw rotor 2 in conjunction with the bore 8 is formed. That is, a bore 11A for housing the male rotor 2A and a bore 11B for housing the female rotor 2B are formed. Therefore, the screw rotor 2 (the male rotor 2A and the female rotor 2B) is housed in the bore 8 (8A and 8B) formed in the main casing 1*a* and the bore 11 (11A and 11B) formed in the slide valve 9.

A compression operation chamber 13A is formed between tooth tips 12A adjacent to each other of the male rotor 2A and between the bores 8A and 11A. A compression operation chamber 13B is formed between tooth tips 12B adjacent to each other of the female rotor 2B and between the bores 8B and 11B. The compression operation chamber 13 (13A and 13B) sequentially changes to, according to rotation of the screw rotor, a compression operation chamber in an air intake stroke for communicating with a suction chamber 21 (see FIG. 1) formed on a suction side (the motor casing 2 side) of the main casing 1*a*, a compression operation chamber in a compression stroke for confining and compressing sucked gas, and a compression operation chamber in a discharge stroke for communicating with a discharge port 22 (see FIG. 1) in a radial direction and discharging the compressed gas.

Note that, as shown in FIG. 1, a suction side shaft section of the male rotor 2A is supported by a roller bearing 14 disposed in the motor casing 1*b*. A discharge side shaft section of the male rotor 2A is supported by a roller bearing 15 and a ball bearing 16 disposed in the discharge casing 1*c*. An outer side end portion of a bearing chamber that houses the roller bearing 15 and the ball bearing 16 is covered with the end cover 1*e*.

A suction side shaft section of the female rotor 2B is supported by a roller bearing (not shown in the figure) disposed in the motor casing 1*b*. A discharge side shaft section of the female rotor 2B is supported by a roller bearing (not shown in the figure) and a ball bearing 17 (see FIG. 4) disposed in the discharge casing 3.

The suction side shaft section of the male rotor 2A is directly connected to the rotating shaft 7 coupled to the rotor 3*a*. The rotor 3*a* rotates, whereby the male rotor 2A rotates. The female rotor 2B also rotates while meshing with the male rotor 2A according to the rotation of the male rotor 2A.

Gas compressed by the screw rotors 2 (2A and 2B) flows out from the discharge port 22 into a discharge chamber 18 formed in the discharge casing 1*a* through a first discharge channel 34 and a second discharge channel 35 formed at an end portion of the slide valve 9. The gas is sent from the discharge chamber 18 to an oil separator 23 provided in the main casing 1*a* through a gas channel 19 (see FIG. 4) provided in the main casing 1*a*. The oil separator 23 separates gas compressed in the screw compressor 1 and oil mixed in the gas. The oil separated by the oil separator 23 is returned to an oil tank 24 provided in a lower part of the screw compressor 1. Separated oil 25 is stored in the oil tank 24. The oil 25 in the oil tank 24 has a nearly discharge pressure. In order to lubricate the bearings 14 to 17 that support the shaft section of the screw rotor 2 and the rotating shaft 7 of the motor 3, the oil 25 is supplied to the bearings 14 to 17 again.

Further, stored oil 25 is supplied into a cylinder 26 formed in the discharge casing 1*c* as oil for driving for reciprocatingly moving the slide valve 9.

On the other hand, high-pressure compressed gas, from which the oil is separated by the oil separator 23, is supplied to the outside (e.g., a condenser configuring a refrigeration cycle) via a pipe (a refrigerant pipe) connected to a discharge section 27.

Figure 3:
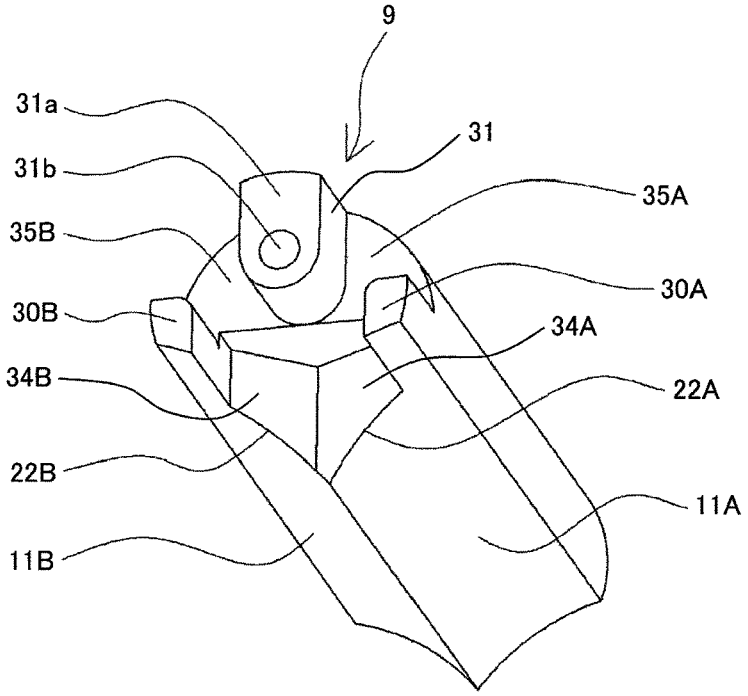
FIG. 3 is a perspective view showing a slide valve shown in FIG. 1.

The configuration of the slide valve 9 is explained in detail below with reference to FIG. 3. FIG. 3 is a perspective view showing the slide valve 9 shown in FIG. 1.

As shown in the figure, at an end portion on a discharge side (the discharge chamber 18 side) of the slide valve 9, the discharge port 22 (22A and 22B) in the radial direction for discharging compressed gas compressed in the compression operation chamber 13 (13A and 13B) to the discharge chamber 18 is formed. That is, the discharge port 22 is formed to be opened to the compression operation chamber 13 in the discharge stroke and configured by a discharge port 22A formed in the bore 11A of the slide valve 9 for housing the male rotor 2A and a discharge port 22B formed in the bore 11B of the slide valve 9 for housing the female rotor 2B.

The configuration of the slide valve 9 is explained more in detail with reference to FIG. 2 as well. As shown in FIG. 2, in the slide valve 9, the bore 11A configuring a part of the compression operation chamber 13A on the male rotor 2A side and the bore 11B configuring a part of the compression operation chamber 13B on the female rotor 2B side are formed. On a discharge side of the bore 11A on the male rotor 2A side and the bore 11B on the female rotor 2B side, as shown in FIG. 3, the discharge ports 22A and 22B and foot sections 30 (30A and 30B) for supporting the slide valve 9 are provided. The foot sections 30 are supported by a casing (the discharge casing 1*c*) provided on both sides on a rotor side of the slide valve 9.

As shown in FIG. 3, a stopper section 31 is provided on the outer diameter side of a discharge chamber side end face (a high-pressure side end face) of the slide valve 9. A stopper surface 31*a* of the stopper section 31 comes into contact with a high-pressure side stopper 41 (see FIG. 1) provided in the discharge casing 1*c* to limit axial direction movement of the slide valve 9. Further, a bolt hole 31*b* for fastening a rod 45 (see FIG. 1) is provided in the stopper section 31.

In this embodiment, a discharge side end portion of the slide valve 9 includes the first discharge channel 34 opened to the compression operation chamber 13 and the discharge chamber 18 via the discharge port 22 (22A and 22B) and the second discharge channel 35 provided on a radial direction outer side of the first discharge channel 34 and opened to the first discharge channel 34 and the discharge chamber 18. The first discharge channel 34 is configured by a discharge channel 34A on the male rotor 2A side and a discharge channel 34B on the female rotor 2B side.

The stopper section 31 is provided on the outer diameter side of the first discharge channel 34. That is, the first discharge channel 34 is formed by a portion between the foot sections 30 (30A and 30B) provided on both sides of the slide valve 9 and a portion on the inner diameter side of the stopper section 31.

The second discharge channel 35 is formed on both sides of the stopper section 31. A part of compressed gas discharged from the discharge port 22 and passing through the first discharge channel 34 flows into the second discharge channel 35 passing between the foot sections 30 and the stopper section 31. The compressed gas flowed into the second discharge channel 35 is thereafter fed out to the discharge chamber 18 (see FIG. 1).

Gas sucked from the sucking section 4 into the low-pressure chamber 5 shown in FIG. 1 cools the stator 3*b* of the motor 3 when passing through the gas passage 6 of the motor casing 1*b*. Thereafter, the gas flows into the compression operation chamber 13 (13A and 13B) formed by the screw rotor 2 via the suction chamber 21 of the screw compressor 1. According to rotation of the male rotor 2A and the female rotor 2B, the compression operation chamber 13 is reduced in volume while moving in the rotor axial direction and the gas is compressed.

The gas compressed in the compression operation chamber 13 is discharged from the discharge port 22 and flows into the discharge chamber 18 passing through the first discharge channel 34 and the second discharge channel 35. Thereafter, after oil is separated by the oil separator 23, the gas is sent out to the outside (the refrigeration cycle) from the discharge section 27.

Note that, in the motor casing 1*b*, a low-pressure side stopper 40 for limiting movement of the slide valve 9 to a rotor axial direction low-pressure side is formed. In the discharge casing 1*c*, the high-pressure side stopper 41 for limiting movement of the slide valve 9 to a rotor axial direction high-pressure side is formed.

One end of the rod 45 is connected to the bolt hole 31*b* of the stopper section 31 (see FIG. 3) of the slide valve 9 provided to be capable of reciprocatingly moving sliding in the slide valve housing hole 10. A piston 46 is connected to the other end side of the rod 45 via a bolt 48.

The piston 46 is housed in the cylinder 26 to be capable of reciprocatingly moving. The cylinder 26 is formed in the discharge casing 1*c*. A rod hole 28, through which the rod 45 pierces, is provided in the discharge casing 1*c*. Further, a seal ring 47 is provided in the outer circumference of the piston 46 and configured to seal spaces (cylinder chambers) on the left and the right of the piston 46.

Figure 4:
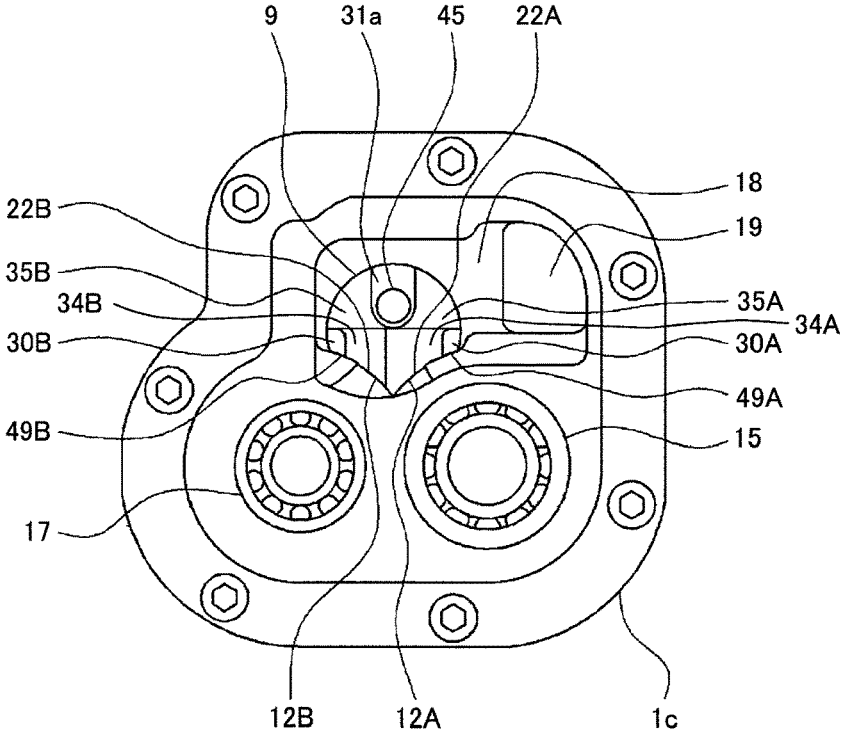
FIG. 4 is an A-A line arrow sectional view of FIG. 1.

FIG. 4 is an A-A line arrow sectional view of FIG. 1. As shown in the figure, in the slide valve 9, the foot sections 30A and 30B are respectively formed on the male rotor side and the female rotor side. The foot sections 30A and 30B are in contact with jaw placing sections 49 (49A and 49B) respectively formed on the male rotor side and the female rotor side of the discharge casing 1*c* and are configured to be capable of sliding in the rotor axial direction. The jaw placing sections 49A and 49B are located further on a radial direction outer side than the tooth tips 12A of the male rotor and the tooth tips 12B of the female rotor and support the slide valve 9 not to come into contact with the screw rotor 2 (the male rotor 2A and the female rotor 2B).

On a discharge side end face of the slide valve 9, the first discharge channel 34 (34A and 34B) and the second discharge channel 35 (35A and 35B) are formed. Compressed gas discharged from the discharge port 22 (22A and 22B) flows into the discharge chamber 18 via the first and second discharge channels 34 and 35. The compressed gas is further sent to the oil separator 23 (see FIG. 1) via the gas channel 19 formed in the main casing 1*a* (see FIG. 1).

Figure 5:
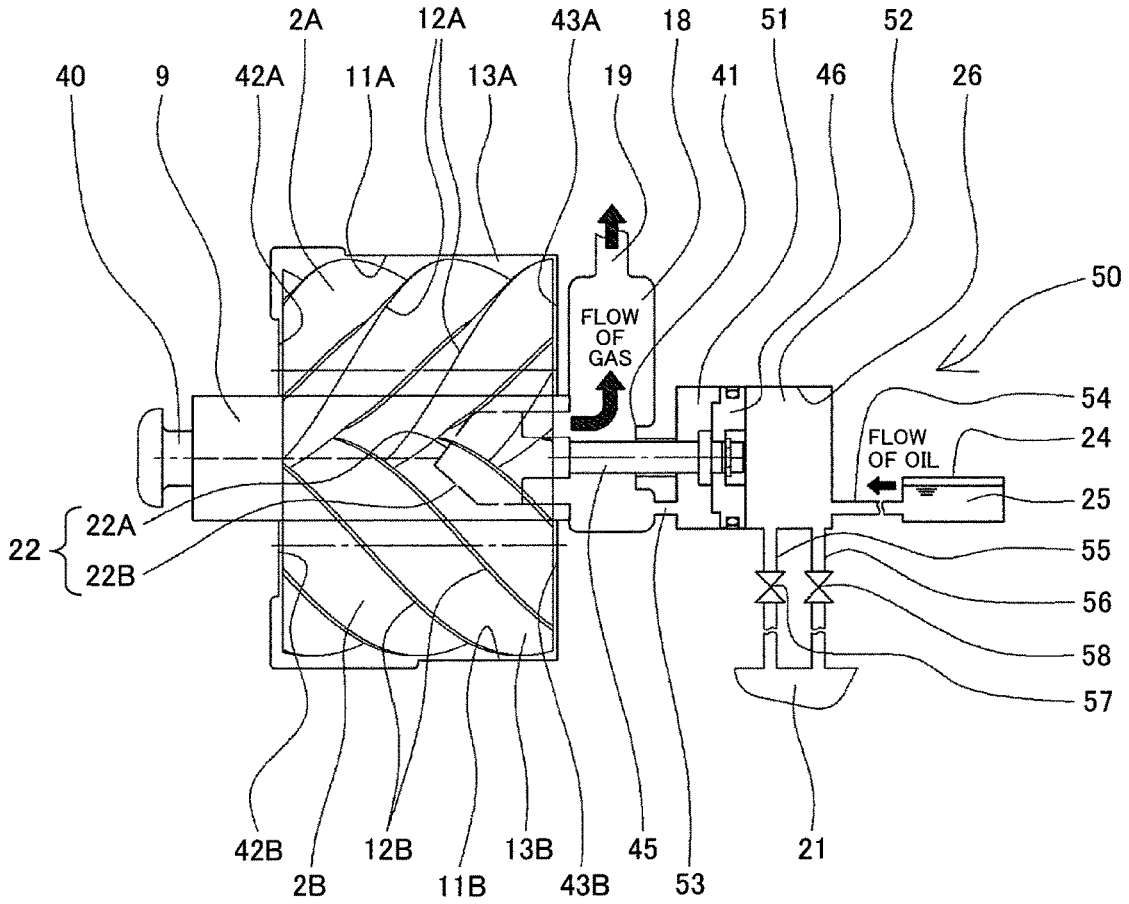
FIG. 5 is an explanatory diagram for explaining the configuration of the slide valve and the vicinity of a driving mechanism section of the slide valve shown in FIG. 1 and is a diagram showing a state in which the slide valve has moved to a low-pressure side most.
Figure 6:
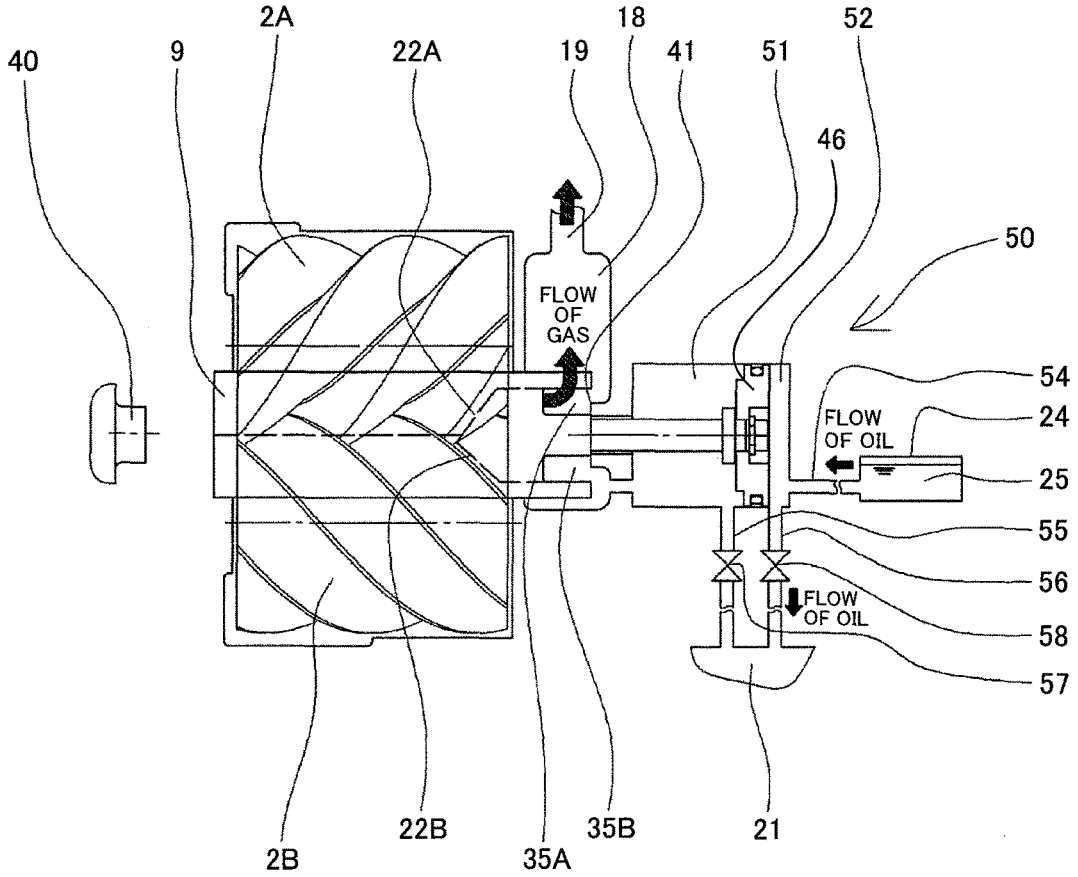
FIG. 6 is an explanatory diagram for explaining the configuration of the slide valve and the vicinity of the driving mechanism section of the slide valve shown in FIG. 1 and a diagram showing a state in which the slide valve has moved to a high-pressure side most.
Figure 7:
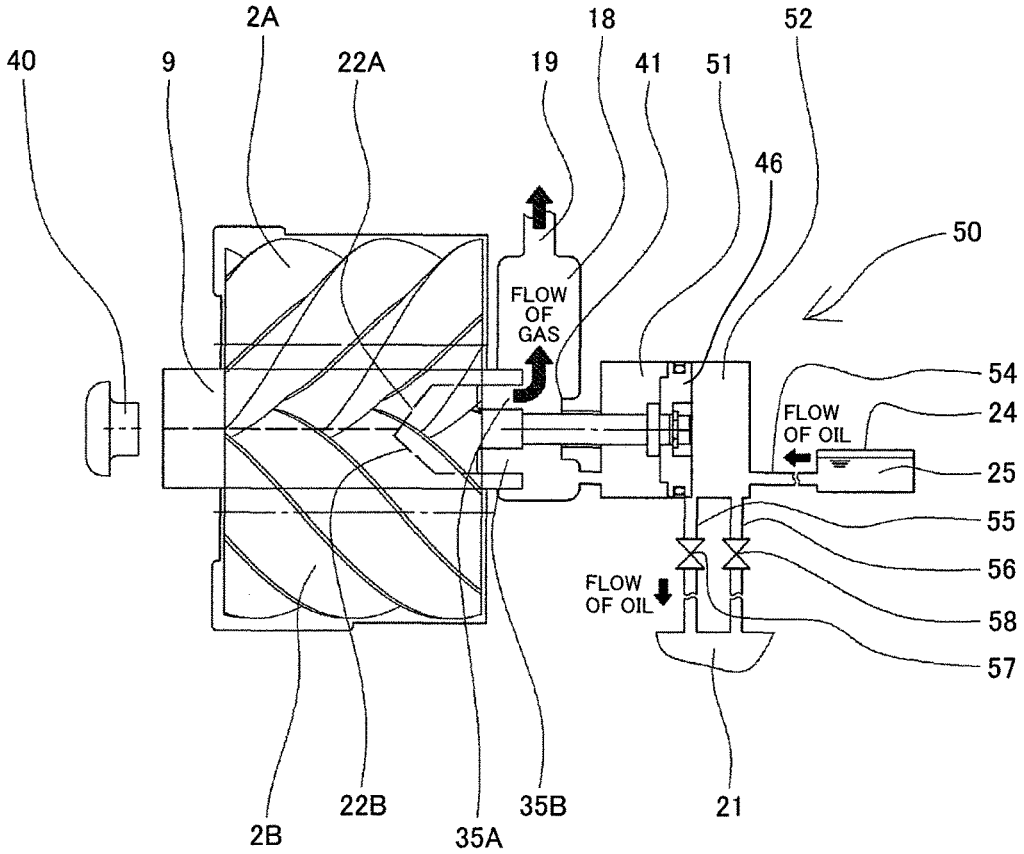
FIG. 7 is an explanatory diagram for explaining the configuration of the slide valve and the vicinity of the driving mechanism section of the slide valve shown in FIG. 1 and is a diagram showing a state in which the slide valve is held in an intermediate position.

FIG. 5 to FIG. 7 are explanatory diagram for explaining the configuration of the slide valve and the vicinity of a driving mechanism section of the slide valve shown in FIG. 1. FIG. 5 is a diagram showing a state in which the slide valve 9 has moved to a low-pressure side most. FIG. 6 is a diagram showing a state in which the slide valve 9 has moved to a high-pressure side most. FIG. 7 is a diagram showing a state in which the slide valve 9 is held in an intermediate position.

First, a flow of compressed gas compressed in the compression operation chamber is explained with reference to FIG. 5 to FIG. 7.

The compression operation chamber 13A is formed by a suction side end face 42A that is in contact with an axial direction suction side end face of the screw rotor 2 in the main casing 1*a* (see FIG. 1) and covers an opening of the bore 11A, the tooth tips 12A adjacent to each other of the male rotor 2A, the bore 11A for housing the male rotor 2A and formed in the radial direction of the male rotor 2A, and a discharge side end face 43A that is in contact with a rotor axial direction discharge side end face of the discharge casing 1*c* (see FIG. 1) and covers an opening of the bore.

The compression operation chamber 13B is formed by a suction side end face 42B that is in contact with the axial direction suction side end face of the screw rotor 2 in the main casing 1*a* and covers an opening of the bore 11B, the tooth tips 12B adjacent to each other of the male rotor 2B, the bore 11B for housing the female rotor 2B and formed in the radial direction of the female rotor 2B, and a discharge side end face 43B that is in contact with the rotor axial direction discharge side end face of the discharge casing 1*c* and covers an opening of the bore 11*b*.

The compression operation chamber 13A and the compression operation chamber 13B communicate with each other and form one compression operation chamber 13.

The compression operation chamber 13 moves in the rotor axial direction while sequentially changing according to rotation of the screw rotor 2. The discharge port 22A formed on the male rotor 2A side of the slide valve 9 is formed in a shape extending along a twisted line of the tooth tips 12A of the male rotor 2A. The discharge port 22B formed on the female rotor 2B side is formed in a shape extending along a twisted line of the tooth tips 12B of the female rotor 2B.

The compression operation chamber 13 moving in the rotor axial direction while sequentially changing according to the rotation of the screw rotor 2 overlaps the discharge port 22 (22A and 22B). At the same time, the compressed gas in the compression operation chamber 13 is discharged from the discharge port 22. The compressed gas discharged from the discharge port 22 flows into the discharge chamber 18 through the first discharge channel 34 (34A and 34B) and the second discharge channel 35 (35A and 35B). Thereafter, the compressed gas is sent to the oil separator 23 (see FIG. 1) from the gas channel 19.

Note that a ratio of a volume Vs of the compression operation chamber 13 during suction closing and a volume Vd of the compression operation chamber 13 immediately before discharge is started from the discharge port 22 is referred to as set volume ratio Vs/Vd. The volume Vd of the compression operation chamber 13 immediately before the discharge start from the discharge port 22 can be increased and reduced by moving the slide valve 9 in the axial direction. Therefore, it is possible to change the set volume ratio Vs/Vd in a range of, for example, 1.5 to 3.5 according to operation of the slide valve 9.

The configuration of a valve-body driving section for moving the slide valve 9 in the axial direction is explained.

In FIG. 5 to FIG. 7, a valve-body driving section 50 includes the rod 45, one end of which is connected to the stopper section 31 of the slide valve 9, the piston 46 connected to the other end side of the rod 45, the cylinder 26 for housing the piston 46 to be capable of reciprocatingly moving in the axial direction, and a cylinder chamber 51 on a rotor side and a cylinder chamber 52 on a counter rotor side formed in the cylinder 26 across the piston 46.

Pressure on a compressor discharge side (the discharge chamber 18) is led into the cylinder chamber 51 on the rotor side via a continuous hole (a continuous path) 53 formed in the discharge casing 1*c* (see FIG. 1). That is, one end side of the continuous hole 53 is opened to the cylinder chamber 51. The other end side of the continuous hole 53 communicates with the discharge chamber 18.

On the other hand, the oil 25 (see FIG. 1 as well) in the oil tank 24 is led into the cylinder chamber 52 on the counter rotor side via a continuous path (an oil supply path) 54. That is, an outer side end portion of the cylinder chamber 52 on the counter rotor side is closed by the end cover 1*e* (see FIG. 1). Apart of the continuous path 54 is formed in the end cover 1*e*. One end of the continuous path 54 is connected to the cylinder chamber 52. The other end side of the continuous path 54 communicates with the oil tank 24. Therefore, oil having high pressure discharge pressure) is always supplied into the cylinder chamber 52.

Further, one end of a first continuous path (an oil discharge path) 55 is opened to a portion on the outer side of a moving range of the piston 46 in the cylinder chamber 52. One end of a second continuous path (an oil discharge path) 56 is opened to the cylinder chamber 52 between an opening section of the first continuous path 55 and an opening section of the continuous path (the oil supply path) 54. The other end sides of the first and second continuous paths 55 and 56 are configured to communicate with a low-pressure space such as the suction chamber 21 (see FIG. 1 as well).

Halfway in the first and second continuous paths 55 and 56, electromagnetic valves 57 and 58 for opening and closing the respective continuous paths 55 and 56 are provided. According to opening and closing of the electromagnetic valves 57 and 58, it is possible to lead high-pressure oil in the oil tank 24 into the cylinder chamber 52 to retain the cylinder chamber 52 at high pressure and discharge the oil in the cylinder chamber 52 to the suction chamber 21 side to thereby move the piston 46 in the axial direction and retain the piston 46 in a predetermined position.

The valve-body driving section 50 configured as explained above operates as explained below.

That is, by closing both of the electromagnetic valves 57 and 58, the cylinder chamber 52 on the counter rotor side (the counter valve body side) is retained at a nearly discharge pressure. Therefore, as shown in FIG. 5, the piston 46 moves to the rotor side (the valve body side) and the slide valve 9 stops in a position where the slide valve 9 is in contact with the low-pressure side stopper 40. FIG. 5 shows a state in which the slide valve 9 moves to the left side most and the set volume ratio Vs/Vd is the smallest.

By closing the electromagnetic valve 57 and opening the electromagnetic valve 58, as shown in FIG. 6, the oil in the cylinder chamber 52 is discharged to the suction chamber 21. Therefore, pressure in the cylinder chamber 52 drops, the piston 46 moves to the counter rotor side, the slide valve 9 stops in a position where the slide valve 9 is in contact with the high-pressure side stopper 41. FIG. 6 shows a state in which the slide valve 9 moves to the right side most and the set volume ratio Vs/Vd is the largest.

Further, by opening the electromagnetic valve 57 and closing the electromagnetic valve 58, for example, from the state shown in FIG. 5, the piston 46 moves to the right side (the counter rotor side) and the position of the piston 46 reaches the position of the first continuous path 55. Then, the oil in the cylinder chamber 52 is not discharged to the suction chamber 21 via the first continuous path 55. Therefore, the pressure in the cylinder chamber 52 rises. The piston 46 cannot further move to the right side and is stopped in the position. From the state shown in FIG. 6, the piston 46 moves to the left side (the rotor side) and the position of the piston 46 reaches the position of the first continuous path 55. Then, the cylinder chamber 51 is retained at the discharge pressure. Conversely, the oil in the cylinder chamber 52 starts to be discharged to the suction chamber 21 via the first continuous path 55. Therefore, the pressure in the cylinder chamber 52 starts to drop. Therefore, the piston 46 cannot further move to the right side and is stopped in the position.

FIG. 7 shows a state in which the slide valve 9 moves to an intermediate position (the position of the first continuous path 55) and stops and the set volume ratio Vs/Vd is a value in the middle of the largest value and the smallest value.

Figure 8:
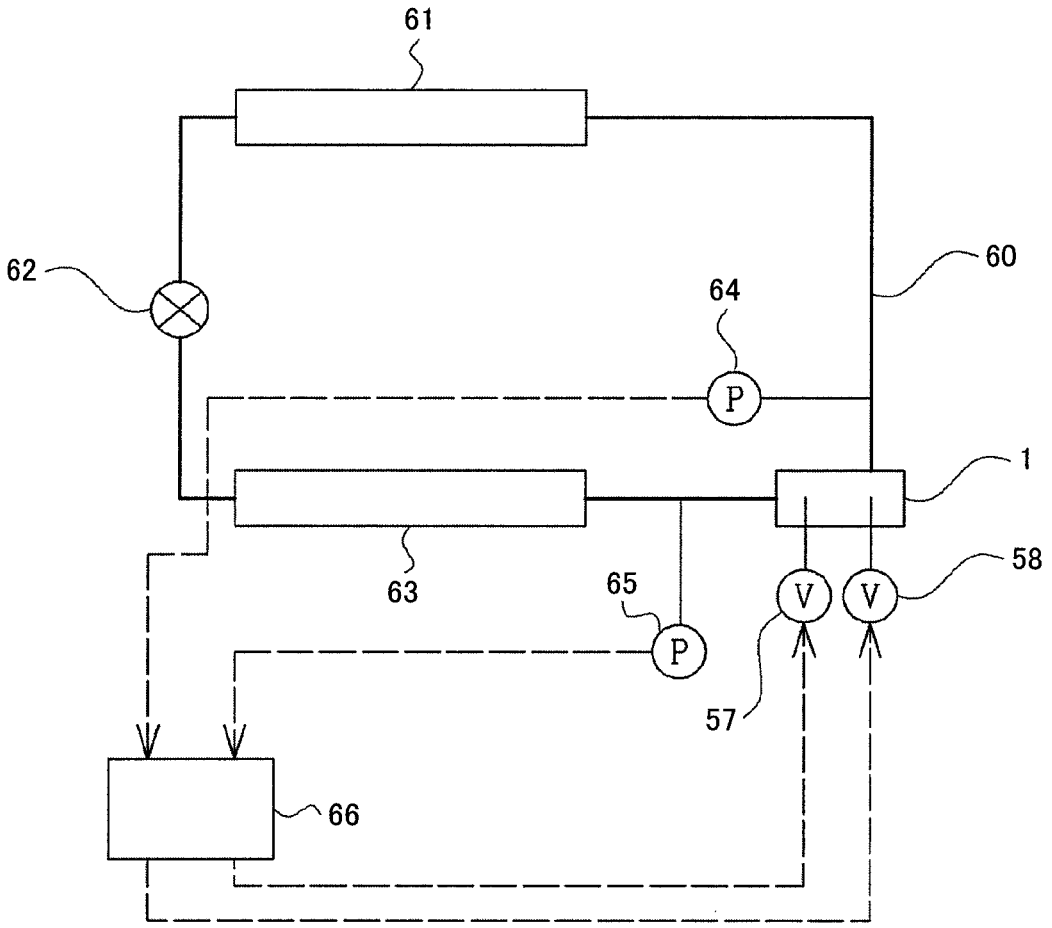
FIG. 8 is a refrigeration cycle system diagram for explaining an example in which a refrigeration cycle is configured using the screw compressor in the first embodiment.

The structure and the operation of the valve-body driving section 50 for driving to open and close the slide valve 9 are explained above with reference to FIGS. 5 to 7. Control for controlling the electromagnetic valves 57 and 58 configuring the valve-body driving section 50 to move the slide valve 9 and adjusting the set volume ratio Vs/Vd is explained below with reference to FIG. 8. FIG. 8 is a refrigeration cycle system diagram showing an example in which a refrigeration cycle is configured using the screw compressor in the first embodiment.

First, the refrigeration cycle shown in FIG. 8 is explained. In FIG. 8, reference numeral 1 denotes a screw compressor (corresponding to the screw compressor shown in FIG. 1). A refrigerant pipe 60 is connected to the discharge section 27 (see FIG. 1) of the screw compressor 1. Via the refrigerant pipe 60, a condenser 61 is connected to a downstream side of the screw compressor 1 and an expansion valve 62 configured by an electronic expansion valve or the like is connected to the downstream side of the condenser 61. Further, an evaporator 63 is connected to the downstream side of the expansion valve 62. An outlet side of the evaporator 63 is connected to the sucking section 4 (see FIG. 1) of the screw compressor 1. These devices are sequentially connected by the refrigerant pipe 60 to configure the refrigeration cycle.

In the refrigerant pipe (a discharge pipe) 60 downstream of the discharge section 27 of the screw compressor 1, a discharge pressure sensor 64 for detecting a discharge side pressure of compressed gas discharged from the screw compressor 1 is provided. In the refrigerant pipe (a suction pipe) 60 on the sucking section 4 side of the screw compressor 1, a suction pressure sensor 65 for detecting a suction side pressure of the screw compressor 1 is provided.

Reference numerals 57 and 58 denote electromagnetic valves configuring the valve-body driving section 50 shown in FIG. 5 and the like and denote electromagnetic valves (valves) for opening and closing the first and second continuous paths 55 and 56.

Reference numeral 66 denotes a control device for calculating a pressure ratio during operation on the basis of detection values in the discharge pressure sensor 64 and the suction pressure sensor 65, determining whether over-compression occurs in the screw compressor, and controlling the electromagnetic valves 57 and 58.

Detection signals from the pressure sensors 64 and 65 are sent to the control device 66. The control device 66 calculates a pressure ratio (a discharge pressure/a suction pressure) during operation at that point in time on the basis of the signals sent from the pressure sensors 64 and 65. A pressure ratio set in advance (a set pressure ratio) is stored in the control device 66. The control device 66 compares the pressure ratio set in advance with the calculated pressure ratio during the operation.

As a result of the comparison, when the calculated pressure during the operation is higher than the pressure ratio set in advance, the control device 66 determines that insufficient compression occurs in the compression operation chamber 13, closes the electromagnetic valve 57 and opens the electromagnetic valve 58, and controls the slide valve 9 to move the high-pressure side as shown in FIG. 6.

When the calculated pressure ratio during the operation is lower than the pressure ratio set in advance, the control device 66 determines that over-compression occurs in the compression operation chamber 13. In this case, the control device 66 closes the electromagnetic valves 57 and 58 and controls the slide valve 9 to move to the low-pressure side as shown in FIG. 5.

When the calculated pressure ratio during the operation is the same as the pressure ratio set in advance, the control device 66 determines that neither the over-compression nor the insufficient compression occurs in the compression operation chamber 13 and retains the slide valve 9 in the present position. For example, the control device 66 opens the electromagnetic valve 57, keeps the electromagnetic valve 58 in the closed state, and controls the slide valve 9 to be retained in the intermediate position as shown in FIG. 7.

The control of the slide valve 9 is more specifically explained with reference to FIG. 5 to FIG. 7. When over-compression does not occur in the compression operation chamber 13 (13A and 13B), the slide valve 9 is controlled to move to the high-pressure side. When over-compression occurs, the slide valve 9 is controlled to move to the low-pressure side.

When the slide valve 9 is controlled to move to the low-pressure side, both of the electromagnetic valves 57 and 58 are changed to a closed state. Consequently, since all of the continuous paths 55 and 56 serving as escape paths of oil are closed in the cylinder chamber 52 on the counter rotor side, the cylinder chamber 52 is filled with oil and has high pressure (≈the discharge pressure).

On the other hand, the cylinder chamber 51 on the rotor side is always filled with gas having high pressure (≈the discharge pressure). Therefore, pressures in the cylinder chamber 51 and the cylinder chamber 52 partitioned by the piston 46 are balanced. However, low pressure (the suction pressure) always acts on the end face on the suction chamber 21 side of the slide valve 9 and high pressure (the discharge pressure) always acts on the end face on the discharge chamber 18 side. Therefore, a driving force in the low-pressure side direction acts on the slide valve 9 according to a pressure difference between the pressures. Therefore, as shown in FIG. 5, the slide valve 9 is pressed against the stopper 40 provided in the motor casing 1*b* (see FIG. 1). The position of the slide valve 9 is retained on the low-pressure side.

When the slide valve 9 is controlled to move to the high-pressure side, the electromagnetic valve 57 is changed to the closed state and the electromagnetic valve 58 is changed to the open state. Consequently, the oil in the cylinder chamber 52 is discharged to the suction chamber 21 side via the second continuous path (the oil discharge path) 56. The pressure in the cylinder chamber 52 drops. On the other hand, the cylinder chamber 51 is always filled with gas having high pressure (≈the discharge pressure). Therefore, as shown in FIG. 6, the slide valve 9 is pressed against the stopper 41 provided in the discharge casing 1*c* (see FIG. 1). The position of the slide valve 9 is retained on the high-pressure side.

Note that when the position of the slide valve 9 is retained on the high-pressure side as shown in FIG. 6, a part (a part on the discharge side) of the slide valve 9 intrudes into the discharge chamber 18. In the conventional screw compressor, the volume of the discharge chamber 18 decreases and the discharge channel is narrowed. Therefore, there is a problem in that a flow of the compressed gas discharged from the discharge port is hindered, a pressure loss increases to cause performance deterioration, and, moreover, a pulsation attenuation effect of the discharged gas decreases, and vibration and noise increase.

On the other hand, in this embodiment, as shown in FIG. 3, the screw compressor includes, at the discharge side end portion of the slide valve 9, the first discharge channel 34 (i.e., the first discharge channel 34 opened to the compression operation chamber 13 and the discharge chamber 18) for leading the compressed gas discharged from the discharge port 22 and leading the compressed gas to the discharge chamber and the second discharge channel 35 provided on the radial direction outer side of the first discharge channel and opened to the first discharge channel 34 and the discharge chamber 18 to lead a part of the compressed gas flowing in the first discharge channel and feed the part of the compressed gas to the discharge chamber.

Consequently, it is possible to lead a part of the compressed gas flowing in the first discharge channel 34 to the discharge chamber 18 and lead the remainder of the compressed gas flowing in the first discharge channel 34 to the discharge chamber 18 via the second discharge channel 35. Therefore, even when a part of the slide valve 9 intrudes into the discharge chamber 18, it is possible to reduce an increase in resistance of a flow (a pressure loss) of the compressed gas discharged from the discharge port 22 and suppress a power increase.

In this embodiment, since the second discharge channel 35 is formed, even if a part of the slide valve 9 intrudes into the discharge chamber 18, it is possible to suppress a volume decrease of the discharge chamber 18. Consequently, it is also possible to attenuate discharge pulsation of the compressed gas discharged from the discharge port 22. An effect that it is possible to suppress an increase in vibration and noise is also obtained.

When the slide valve 9 is controlled to be retained in the middle, the electromagnetic valve 57 is changed to the open state and the electromagnetic valve 58 is changed to the closed state. Consequently, the oil in the cylinder chamber 52 is discharged to the suction chamber 21 side via the first continuous path (the oil discharge path) 55. The pressure in the cylinder chamber 52 drops. On the other hand, the cylinder chamber 51 is always fills with gas having high pressure (≈the discharge pressure). Therefore, as shown in FIG. 7, in the piston 46, a driving force in the low-pressure side direction always acting on the slide valve 9 in the position of the opening section on the cylinder chamber 52 side of the first continuous path 55 and a driving force in the counter rotor side direction acting on the piston are balanced. The slide valve 9 is retained in the position (the intermediate position).

Note that, by providing a plurality of the first continuous paths 55 to be shifted in the axial direction rather than providing only one first continuous path 55, the slide valve 9 can be configured to be retained in a plurality of any positions to correspond to the plurality of continuous paths 55 within a range, for example, where the set volume ratio Vs/Vd is 1.5 to 3.5.

As explained above, according to this embodiment, the screw compressor includes, at the discharge side end portion of the slide valve 9, the first discharge channel 34 for leading the compressed gas discharged from the discharge port 22 and leading the compressed gas to the discharge chamber and the second discharge channel 35 provided on the radial direction outer side of the first discharge channel and opened to the first discharge channel 34 and the discharge chamber 18 to lead a part of the compressed gas flowing in the first discharge channel and feed the part of the compressed gas to the discharge chamber. Therefore, it is possible to lead a part of the compressed gas flowing in the first discharge channel 34 to the discharge chamber 18 and lead the remainder of the compressed gas flowing in the first discharge channel 34 to the discharge chamber 18 via the second discharge channel 35. Therefore, even when a part of the slide valve 9 intrudes into the discharge chamber 18, it is possible to reduce an increase a pressure loss of the compressed gas discharged from the discharge port 22 and suppress a power increase. Further, it is possible to suppress a volume decrease in the discharge chamber 18 as well. Therefore, it is possible to maintain the effect of attenuating discharge pulsation of the compressed gas discharged from the discharge port 22. Consequently, an effect that is it possible to suppress an increase in vibration and noise is also obtained.

According to this embodiment, the slide valve 9 is controlled using high-gas pressure (the discharge pressure) and oil pressure nearly the discharge pressure irrespective of the pressure in the compression operation chamber 13. Therefore, it is possible to surely control the slide valve 9 to a predetermined position irrespective of an operation pressure condition of the screw compressor. Therefore, it is also possible to reduce over-compression and insufficient compression and achieve performance improvement.

Further, in this embodiment, as in Patent Literature 1 described above, a fluctuating pressure of the compression operation chamber 13 involved in the rotation of the screw rotor 2 does not directly act on the cylinder chamber 52. Therefore, the valve-body driving section 50 is not affected by the fluctuating pressure of the compression operation chamber 13. Therefore, the slide valve 9 does not reciprocatingly slide bit by bit in the axial direction in association with pressure fluctuation in the compression operation chamber 13. It is possible to move the slide valve 9 to a predetermined position and stably retain the slide valve 9 in the position. Therefore, according to this embodiment, it is possible to prevent the foot sections 30 of the slide valve 9 from abnormally wearing. It is possible to obtain a screw compressor having high reliability.

Another example of the slide valve 9 is explained with reference to FIG. 9 and FIG. 10. In the figures, portions denoted by reference numerals and signs same as the reference numerals and signs in FIG. 1 to FIG. 8 are the same or equivalent portions.

Figure 9:
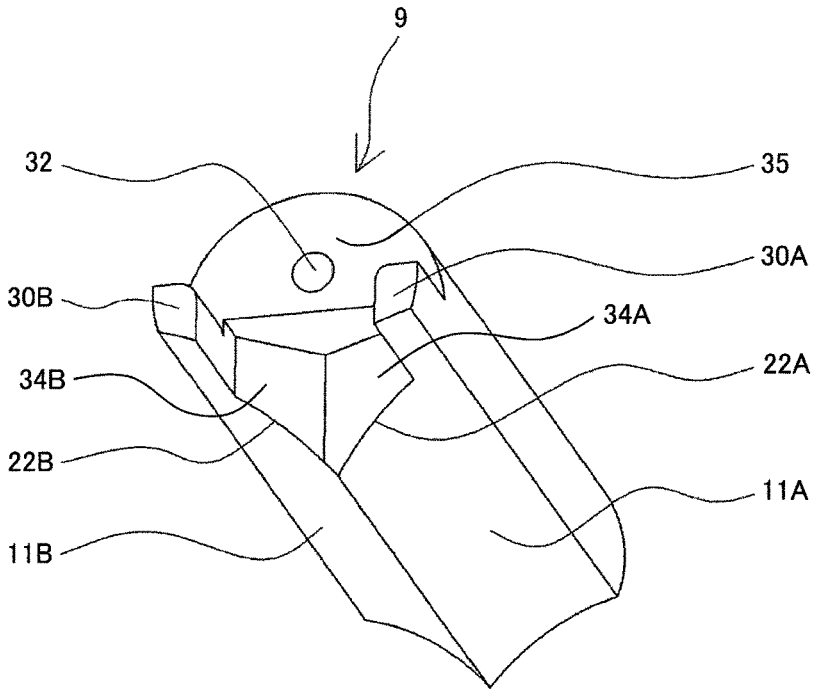
FIG. 9 is a perspective view showing another example of the slide valve shown in FIG. 1 and is a diagram corresponding to FIG. 3.

FIG. 9 is a perspective view showing another example of the slide valve shown in FIG. 1 and is a diagram corresponding to FIG. 3.

In the example shown in FIG. 9, a seat forming the stopper section 31 of the slide valve 9 is eliminated and end faces of the foot sections (the supporting sections) 30 (30A and 30B) are configured to be in contact with a part of the discharge casing 1*c* to limit axial direction movement of the slide valve 9. That is, in this example, a portion further on the outer diameter side than the foot sections 30 on the discharge side end face of the slide valve 9 is formed as a flat surface. The second discharge channel 35 is formed in the portion of the flat surface.

By configuring the slide valve 9 in this way, the seat forming the stopper section 31 shown in FIG. 3 can be eliminated in the slide valve 9. It is possible to expand a channel area of the second discharge channel 35. Therefore, it is possible to further reduce the pressure loss of the flow. It is possible to further attenuate the discharge pulsation of the compressed gas discharged from the discharge port 22. It is possible to increase the suppression effect of vibration and noise.

Note that reference numeral 32 denotes a bolt hole provided in an end face of a portion forming the second discharge channel 35 of the slide valve 9. The bolt hole 32 is the same as the bolt hole 31*b* shown in FIG. 3.

Figure 10:
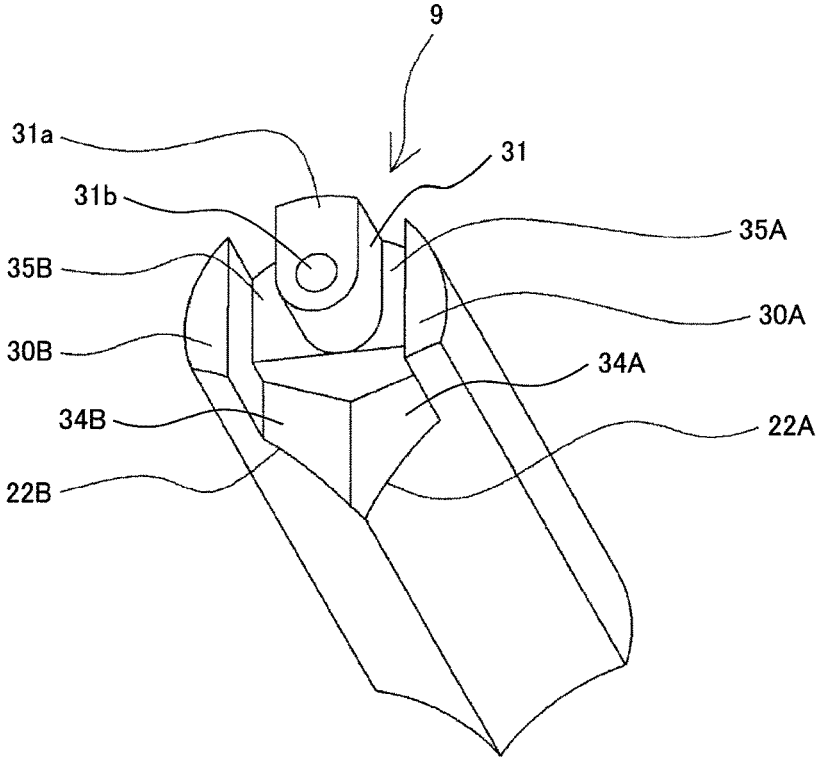
FIG. 10 is a perspective view showing still another example of the slide valve shown in FIG. 1 and is a diagram corresponding to FIG. 3.

FIG. 10 is a perspective view showing still another example of the slide valve shown in FIG. 1 and is a diagram corresponding to FIG. 3. In the example shown in FIG. 10, the foot sections 30 (30A and 30B) of the slide valve 9 are extended in the radial direction and the second discharge channel 35 (35A and 35B) is formed in a straight shape. The other components are the same as the components of the slide valve shown in FIG. 3.

By configuring the slide valve 9 in this way, it is possible to easily perform machining of the second discharge channel 35. It is possible to inexpensively manufacture the slide valve 9. When the slide valve 9 is formed of a casting, since the second discharge channel 35 is formed straight, the strength of the foot sections 30 increases and the number of cores can be reduced. Therefore, there is an effect that it is possible to improve manufacturability.

Note that the present invention is not limited to the embodiment explained above and includes various modifications.

For example, in the embodiment, the casing of the compressor is divided into the three casing of the main casing 1*a*, the motor casing 1*b*, and the discharge casing 1*c*. However, the casing is not limited to be divided into three and may be divided into two or may be divided into four or more. In the above explanation, the slide valve is the volume ratio valve. However, the explanation can also be applied when the slide valve is a volume control valve that adjusts a suction flow rate.

Further, the embodiment is explained in detail in order to clearly explain the present invention and is not always limited to the screw compressor including all of the components explained above.

REFERENCE SIGNS LIST

1: screw compressor (compressor main body)
1*a*: main casing
1*b*: motor casing
1*c*: discharge casing
1*d*: motor cover
1*e*: end cover
2: screw rotor (2A: male rotor, 2B: female rotor)
3: motor (3*a*: rotor, 3*b*: stator)
4: sucking section
5: low-pressure chamber
6: gas passage
7: rotating shaft
8 (8A, 8B), 11 (11A, 11B): bore
9: slide valve
10: slide valve housing hole
12A, 12B: tooth tip
13 (13A, 13B): compression operation chamber
14, 15: roller bearing
16, 17: ball bearing
18: discharge chamber
19: gas channel
21: suction chamber
22: discharge port (22A: male rotor side discharge port, 22B: female rotor side discharge port)
23: oil separator
24: oil tank
25: oil
26: cylinder
27: discharge section
28: rod hole
30 (30A, 30B): foot section (supporting section)
31: stopper section
31*a*: stopper surface
31*b*, 32: bolt hole
34 (34A, 34B): first discharge channel
35 (35A, 35B): second discharge channel
40: low-pressure side stopper
41: high-pressure side stopper
42 (42A, 42B): suction side end face
43 (43A, 43B): discharge side end face
45: rod
46: piston
47: seal ring
48: bolt
49 (49A, 49B): jaw placing section
50: valve-body driving section
51, 52: cylinder chamber
53: continuous hole (continuous path)
54: continuous path (oil supply path)
55: first continuous path
56: second continuous path
57, 58: electromagnetic valve (valve)
60: refrigerant pipe
61: condenser
62: expansion valve

63: evaporator
64: discharge pressure sensor
65: suction pressure sensor
66: control device

The invention claimed is:

1. A screw compressor comprising:
a male rotor;
a female rotor that meshes with the male rotor;
a casing that includes a bore for housing the male rotor and the female rotor and in which a suction chamber is disposed on a suction side and a discharge chamber is disposed on a discharge side;
a slide valve forming a part of the bore and that is movable in an axial direction of the male rotor and the female rotor, the slide valve having a main body and a discharge side end face;
a plurality of foot sections protruding in the axial direction from the discharge side end face of the slide valve that supports the slide valve in the casing; and
a discharge port disposed on the discharge side of the slide valve to discharge, to the discharge chamber, compressed gas taken into a compression operation chamber formed by the male rotor, the female rotor, and the casing from the suction chamber and compressed,
wherein the slide valve comprises:
at the discharge side thereof, a first discharge channel to lead the compressed gas discharged from the discharge port and lead the compressed gas to the discharge chamber, and a second discharge channel open to the first discharge channel and the discharge chamber that includes a portion of the discharge side end face that is at an outer periphery of the main body, the second discharge channel to lead a part of the compressed gas flowing in the first discharge channel and feed the part of the compressed gas to the discharge chamber, and
wherein the portion of the discharge side end face at the outer periphery of the main body of the second discharge channel and end surfaces of the foot sections are in different planes.

2. The screw compressor according to claim 1, further comprising:
a stopper structure protruding from the discharge side end face in the axial direction and having a portion thereof at the outer periphery of the main body,
wherein the foot sections are closer to both the male rotor and the female rotor than the stopper structure.

3. The screw compressor according to claim 2, wherein
the first discharge channel is disposed between the foot sections,
wherein the stopper section is disposed within the second channel, and
wherein the first discharge channel is closer to both the male rotor and the female rotor than the second discharge channel in a radial direction.

4. The screw compressor according to claim 2, wherein the second discharge channel includes a portion of the discharge side end face that is a flat surface and is perpendicular to a main axis of the main body of the slide valve.

5. The screw compressor according to claim 1, wherein respective outer surfaces of the foot sections are at the outer periphery and the first discharge channel is disposed between the foot sections, and
wherein the end surfaces of the foot sections are configured to come into contact with a part of the casing to limit axial direction movement of the slide valve.

6. The screw compressor according to claim 5, wherein the second discharge channel includes a portion of the discharge side end face that is a flat surface and is perpendicular to a main axis of the main body of the slide valve.

7. The screw compressor according to claim 1, wherein
the slide valve is a volume ratio valve configured to change a volume ratio of the compressor, and the screw compressor includes a valve-body driving device for driving the slide valve, the valve-body driving device including:
a piston connected to the slide valve;
a cylinder for housing the piston to be capable of reciprocatingly moving in the axial direction;
a continuous path for leading oil in a high-pressure space to a cylinder chamber on a counter rotor side of the piston;
a first continuous path for connecting an inside of the cylinder chamber on the counter rotor side of the piston and a low-pressure space of the compressor;
a second continuous path for connecting the inside of the cylinder chamber on the counter rotor side of the piston and the low-pressure space of the compressor and opened to the cylinder chamber between the continuous path for leading the oil in the high-pressure space and the first continuous path; and
a plurality of valves provided in the respective first and second continuous paths and for opening and closing the respective continuous paths, and
when over-compression or insufficient compression occurs in the compression operation chamber, the valve-body driving device opens and closes the valves provided in the respective first and second continuous paths to thereby move the slide valve via the piston to change a volume ratio in the compression operation chamber and reduce a state of the over-compression or the insufficient compression.

8. The screw compressor according to claim 7, further comprising:
a continuous path for connecting an inside of a cylinder chamber on a rotor side of the piston and the discharge side of the compressor.

9. The screw compressor according to claim 7, further comprising:
a discharge pressure sensor for detecting a discharge side pressure of the compressor;
a suction pressure sensor for detecting a suction side pressure of the compressor; and
a controller configured to:
calculate a pressure ratio during operation on the basis of detection values in the discharge pressure sensor and the suction pressure sensor,
compare the pressure ratio with a set pressure ratio stored in advance,
determine whether over-compression or insufficient compression occurs in the compression operation chamber, and
control the valves respectively provided in the first and second continuous paths.

10. The screw compressor according to claim 9, wherein the controller controls the valves provided in the first and second continuous paths to move the slide valve to a low-pressure side when determining that the over-compression occurs and move the slide valve to a high-pressure side when determining that the insufficient compression occurs.

* * * * *